US006393611B1

(12) United States Patent
Thompson

(10) Patent No.: US 6,393,611 B1
(45) Date of Patent: May 28, 2002

(54) WOMEN'S UNDER/OUTER GARMENT

(76) Inventor: Kathryn H. Thompson, 227 Falcon Ridge Rd., Great Falls, VA (US) 22066

( * ) Notice: Subject to any disclaimer, the term of this patent is extended or adjusted under 35 U.S.C. 154(b) by 0 days.

(21) Appl. No.: 09/795,523

(22) Filed: Mar. 1, 2001

(51) Int. Cl.[7] ..... A41C 3/00
(52) U.S. Cl. ..... 2/55; 450/1
(58) Field of Search ..... 2/53–57, 105, 2/125, 126, 106, 90, 113–115, 69, 78.1–78.3, 73; 450/86, 89, 1, 7–11, 15–17, 23, 26, 28, 30, 31–33, 35

(56) References Cited

U.S. PATENT DOCUMENTS

| | | | | | |
|---|---|---|---|---|---|
| 24,033 | A | | 5/1859 | Lesher | |
| 480,426 | A | | 8/1892 | Goldsmith | |
| 593,175 | A | | 11/1897 | Heyman | |
| 933,265 | A | | 9/1909 | Reid | |
| 1,236,720 | A | | 8/1917 | Kotek | |
| 1,254,043 | A | | 1/1918 | James | |
| 2,250,094 | A | | 7/1941 | Cornibert et al. | |
| 2,493,179 | A | | 1/1950 | Wittenbverg | |
| 2,880,731 | A | | 4/1959 | Kendall | |
| 3,037,210 | A | * | 6/1962 | Neuman | 2/115 |
| 3,421,514 | A | | 1/1969 | Friedlander | 128/454 |
| 3,474,465 | A | * | 10/1969 | Artzt | 2/115 |
| 3,490,459 | A | | 1/1970 | Story | |
| 3,508,279 | A | * | 4/1970 | Ayoub | 2/115 |
| 3,746,007 | A | | 7/1973 | Hand et al. | 128/455 |
| 3,826,266 | A | | 7/1974 | Alpert | 128/435 |
| D232,602 | S | | 9/1974 | Greenblat et al. | |
| 4,601,069 | A | * | 7/1986 | Fiore, Jr. et al. | 2/106 |
| 4,625,338 | A | | 12/1986 | Starling | 2/106 |
| 4,675,917 | A | * | 6/1987 | Valli | 2/106 X |
| 4,866,791 | A | * | 9/1989 | Carrer et al. | 2/106 |
| 4,937,883 | A | * | 7/1990 | Shirai | 2/115 |
| 5,042,089 | A | | 8/1991 | Carmer | 2/55 |
| 5,897,422 | A | | 4/1999 | McGee | 450/58 |
| 5,946,726 | A | | 9/1999 | Green | 2/109 |
| 6,000,993 | A | | 12/1999 | Erwin | 450/7 |
| 6,183,339 | B1 | * | 2/2001 | Thompson | 450/1 |

* cited by examiner

*Primary Examiner*—Gloria M. Hale
(74) *Attorney, Agent, or Firm*—Hunton & Williams

(57) ABSTRACT

A women's sleeved under/outer garment is provided for fitting snuggly over a conventional brassiere (or other undergarment) and for concealing or covering a wearer's arms without adding undue bulkiness about the torso of the wearer. The sleeved under/outer garment may be used to conceal any flabbiness, wrinkles, or age spots that may exist on the arm of the wearer without adding undue bulkiness about the torso of the wearer.

11 Claims, 4 Drawing Sheets

WOMEN'S UNDER/OUTER GARMENT

FIELD OF THE INVENTION

The present invention relates to women's sleeved under/outer garments, and more particularly to such a garment for use over a brassiere (or other undergarment) wherein the garment fits snugly over the brassiere (or other undergarment) without adding undue bulkiness about the torso of the wearer and further comprises sleeves for covering a wearer's arms.

BACKGROUND OF THE INVENTION

It is natural for skin flabbiness and wrinkles to develop in the upper arms and forearms of a person due to muscle aging and excess weight. As a result, many people feel that their arms are heavy or unattractive, especially when wearing sleeveless apparel. At the present time, the primary option available to conceal one's arms when wearing sleeveless apparel is to wear a bulky sleeved undershirt beneath the sleeveless garment. However, many sleeveless garments on the market, such as tank-tops and form fitting dresses, are not designed to be worn with such undershirts.

SUMMARY OF THE INVENTION

A women's sleeved under/outer garment is provided for concealing a wearer's arms without adding undue bulkiness about the torso of the wearer. The under/outer garment may comprise sleeves for covering a wearer's arms and a brassiere section for fitting snuggly over a conventional brassiere.

The present invention provides an under/outer garment with sleeves for concealing any flabbiness, wrinkles, age spots or other imperfections that may exist on the arm of the wearer without adding undue bulkiness about the torso of the wearer. The sleeves may further include an elasticized portion along the under-arm of the intended wearer to further prevent undue bulkiness. In addition, the sleeves may comprise shoulder sections that may be used to hide shoulder straps of a conventional brassiere and further maintain the shoulder straps in place to prevent the shoulder straps from slipping off the shoulder of the wearer.

The present invention provides an under/outer garment comprising a section for fitting snuggly over a conventional brassiere instead of having a brassiere incorporated into the under/outer garment. Conventional brassieres are available in a variety of styles, including embroidered, lace and other decorative enhancements and/or patterns on the cups of a conventional brassiere. When worn with a tight fitted outer garment, oftentimes the enhancements and/or patterns of a conventional brassiere may show through. The under/outer garment of the present invention may be worn to provide a sleek covering over a conventional brassiere of any variety to conceal or obscure the patterns on the conventional brassiere to thereby enhance the appearance of the wearer.

According to an embodiment of the present invention, an under/outer garment may comprise at least two different fabrics wherein the first fabric comprises a thin elastic type material to ensure a snug fit over the brassiere section and a second fabric for creating an aesthetic look about the sleeves and shoulder sections.

The present invention provides a women's sleeved under/outer garment that fits snuggly over a conventional brassiere or other undergarment while covering the wearer's arms without adding undue bulkiness about the torso of the wearer to add versatility to a wearer's wardrobe. The under/outer garment may be worn with tank dresses, tank tops and other form fitting dresses to conceal the wearer's arms and/or minimize flabbiness of the wearer's arms without adding undue bulkiness about the torso of the wearer. Further, the under/outer garment may be worn with strapless as well as sleeveless apparel to effectively create sleeves and coverage.

The accompanying drawings, which are incorporated in and constitute a part of this specification, illustrate various embodiments of the invention and, together with the description, serve to explain the principles of the invention.

DETAILED DESCRIPTION OF THE PREFERRED EMBODIMENTS

Figure 1:
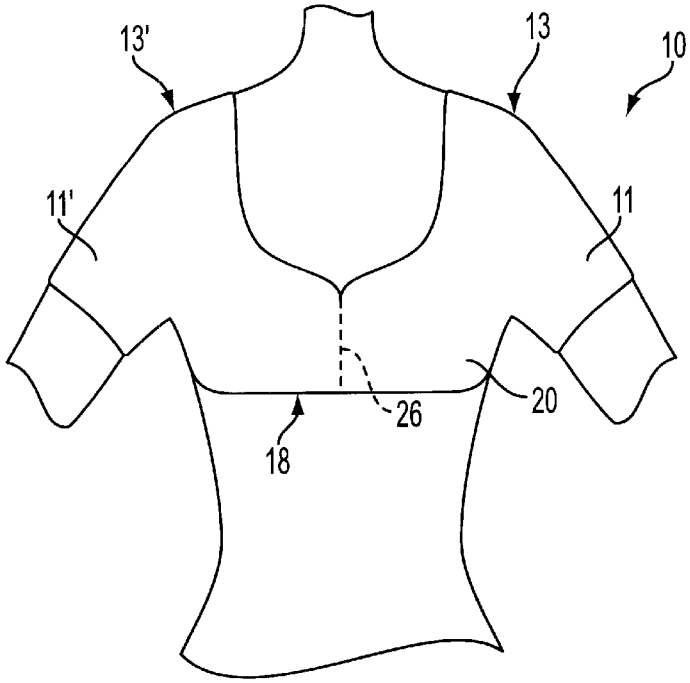
FIGS. 1 and 2 illustrate front and back views of a women's sleeved under/outer garment, according to an embodiment of the present invention.
Figure 2:
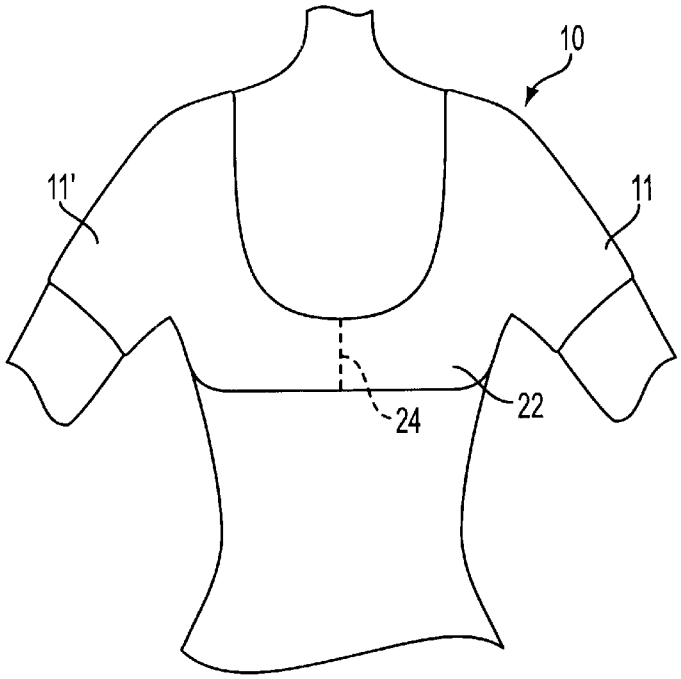

With reference to the drawings in detail, and initially to FIGS. 1–2 thereof, a women's sleeved under/outer garment 10 is provided in accordance with an embodiment of the invention.

FIG. 1 illustrates a front view of an under/outer garment 10, according to an embodiment of the present invention. Under/outer garment 10 generally comprises a brassiere section 20 for covering a traditional brassiere (not shown) and sleeves 11 and 11' for covering a wearer's arms.

Brassiere section 20 may comprise an elastic material for fitting snuggly over a traditional brassiere for creating a sleek look. According to another embodiment of the present invention, brassiere section 20 may also comprise a foam type material to form cup portions for desired support. Other materials may be used to form the brassiere section. Brassiere section 20 and sleeves 11 and 11' may be made of a substantially similar material.

The sleeves 11 and 11' may be long (not shown) or short, and may be shaped in any manner to achieve the desired coverage and appearance. For instance, the sleeves may be fitted around the wearer's arms for a sleek look (see FIGS. 1, 2, 5 and 6), or they may be loose and contoured or flared for a more formal look (see FIGS. 3 and 4). Different materials may be used to create a desired look (see FIGS. 7 and 8). For example, a firmer elastic material may be used over the brassiere section and a sheer (or other material) may be used for the sleeves, or as otherwise desired. Other variations may be implemented for creating a preferred appearance.

Sleeves 11 and 11' may further comprise shoulder sections 13 and 13' which may be made of the same (or substantially similar) material as the sleeves. For example, the shoulder sections may comprise an elastic or tight material for creating a sleek, fitted look about the shoulder sections. In addition, the shoulder sections may serve to maintain straps of a conventional brassiere in place to thereby prevent the straps from slipping off the shoulders of the wearer. The sleeves may be permanently attached or removable.

Lower midriff edge 18 may be formed just below the bust line of a conventional brassiere to provide a snug fit over a conventional brassiere. The lower midriff edge 18 may be positioned as to minimize undue bulkiness of the torso thereby providing a sleek look when worm under an outer garment. Lower midriff edge 18 may be positioned in different locations for a desired effect. For example, the lower midriff edge may be positioned lower to provide support about the torso region of the wearer.

In FIG. 2, the under/outer garment 10 depicted in FIG. 1 is shown in a rear view. Under/outer garment 10 may include a back portion 22 which may include a back closure 24. Back closure 24 may include a closure mechanism, such as Velcro™, snap, hook-and-eye fasteners, buttons, tie or other type of fastener. In another embodiment, the closure may be in the front of the under/outer garment 10, as illustrated by 26. Further, the garment may be of a pull-over style without a closure mechanism (e.g., fastener). Other variations may be implemented.

Figure 3:
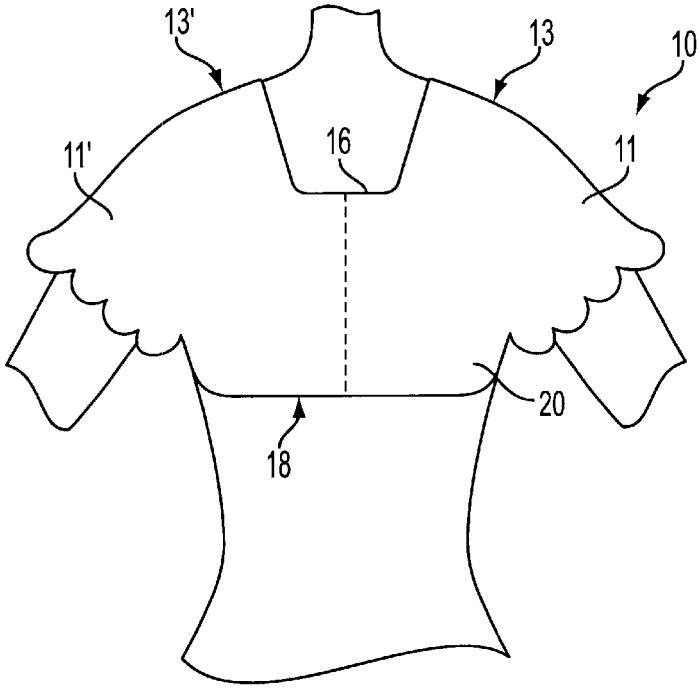
FIGS. 3 and 4 illustrate front and back views of another embodiment of the present invention including decorative sleeves.
Figure 4:
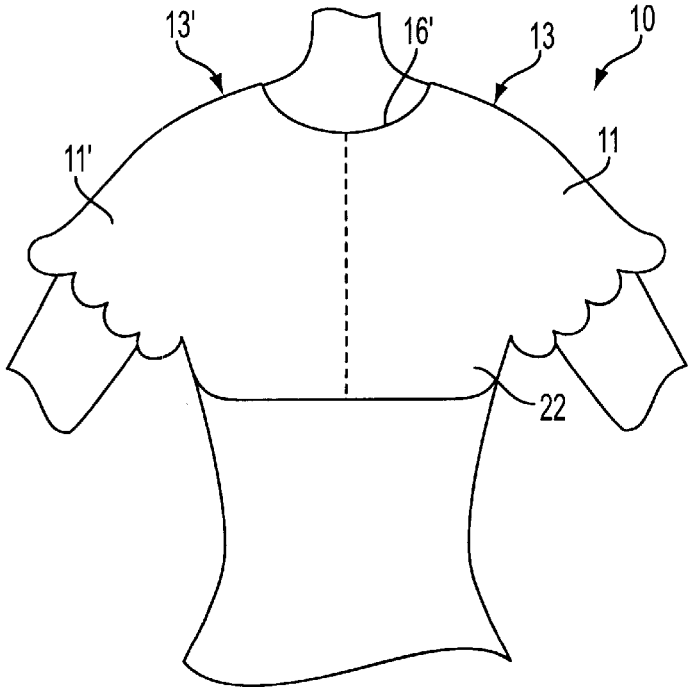

FIGS. 3 and 4 illustrate front and back views of another embodiment of the present invention. With reference to FIG. 3, an under/outer garment 10 similar to that depicted in FIG. 1 is shown. In the embodiment of FIG. 3, the sleeves 11 and 11' may be loose and contoured for a more formal look.

Shoulder portions 13 and 13' may be made of a different material than sleeves 11 and 11' to enable shoulder support while providing a flared and loose look about the sleeves. Other variations may be implemented.

Under/outer garment 10 may be formed from any material known in the art depending on the aesthetic qualities desired. For instance, cotton can be used for a more casual look, or sheer materials may be used for a more formal look. The brassiere section 20 may be formed from the same (or substantially similar) material as sleeves 11 and 11', or may be a different material if so desired. Neckline 16 may be shaped in any fashion known in the art, such as square (as shown in FIG. 3), crew (as shown in FIG. 5), sweetheart, boatneck, scoop, flat, turtleneck, collared, cowl or "v-neck" in shape.

Figure 8:
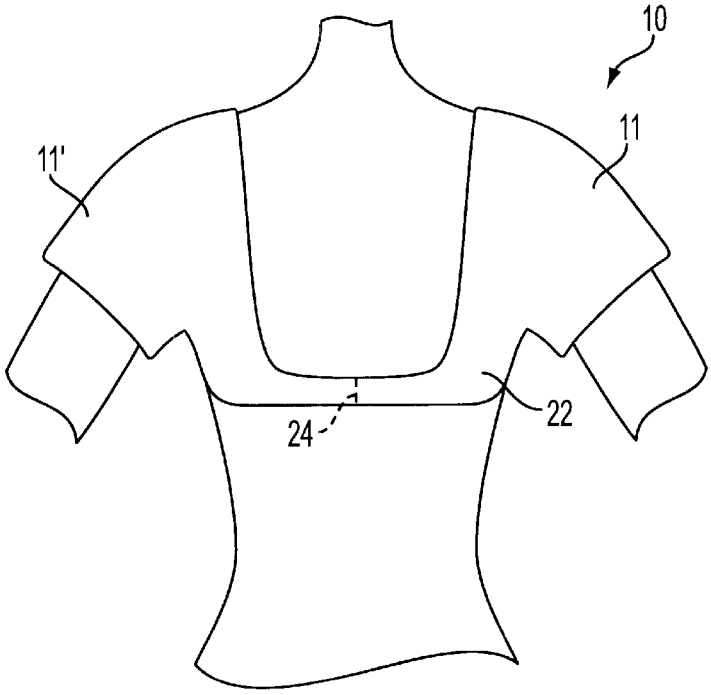

FIG. 4 illustrates a rear view of under/outer garment 10 as illustrated in FIG. 3. Back portion 22 may likewise be configured in a variety of ways, depending on the aesthetic qualities desired. For instance, back portion 22 may vary in the extent of coverage and back-neckline 16' shape. More particularly, back portion 22 may extend to just below the neck line of the wearer (as shown in FIG. 4), or may only extend to a mid-region of the wearer's back (as shown in FIG. 8). Further, back-neckline 16' may be shaped in any desired manner, including square, crew (as shown in FIG. 4), boatneck, scoop (as shown in FIG. 8), flat, turtleneck, collared, cowl or "v-neck" in shape. Any combination of neckline or covering configuration may be possible and within the scope of the present invention.

Figure 5:
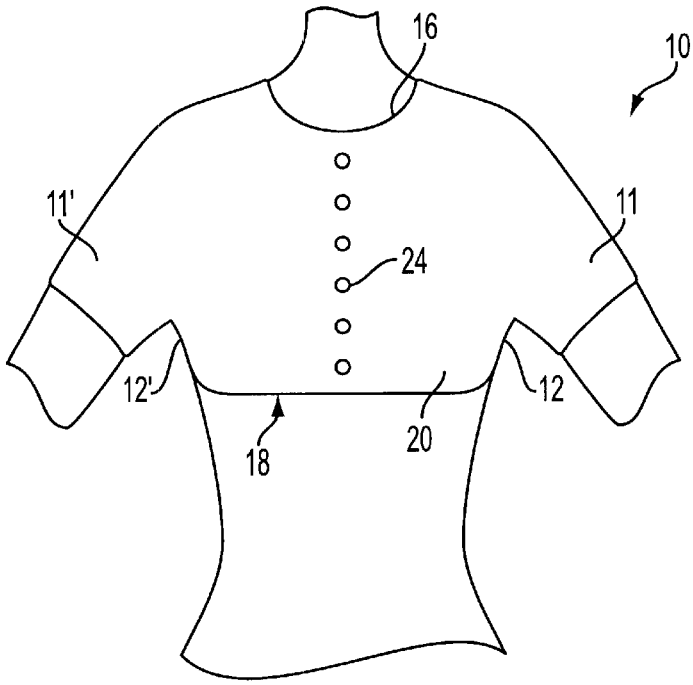
FIGS. 5 and 6 illustrate front and back views of yet another embodiment of the present invention including tight fit under-arm regions.
Figure 6:
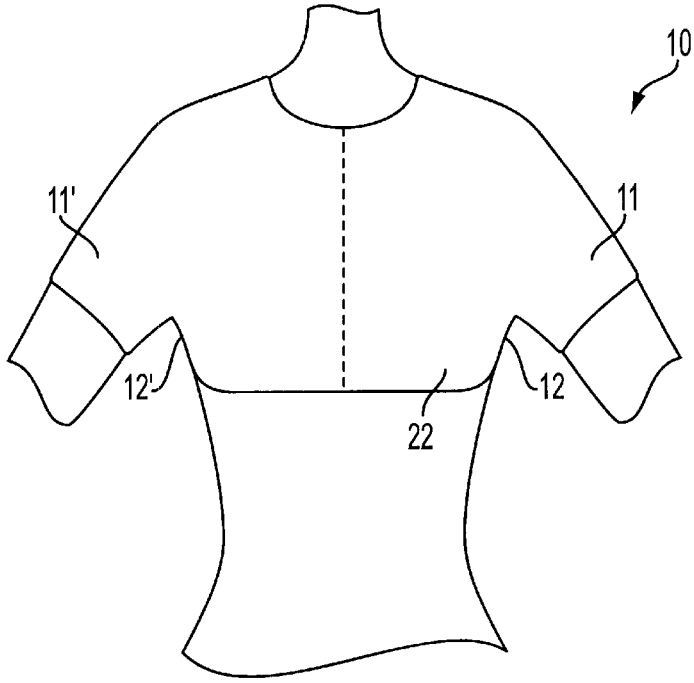

FIGS. 5 and 6 illustrate front and back views of an embodiment of the present invention wherein an under/outer garment comprises sleeves made of tight fitting material. According to an embodiment of the present invention, bulkiness may be further prevented by providing sleeves 11 and 11' with portions of tight fitting material 12 and 12' along the under-arm region, as shown in FIGS. 5 and 6. In this embodiment of the present invention, bulkiness may be reduced by providing for a snug fit along the underarm region of the wearer to thereby result in a smoother look when worn. The material used in this tight fitting area may be any elasticized or stretchable material known in the art.

Under/outer garment 10 of the present invention may further comprise a variety of ornamental designs on the front, back and/or sleeves of the garment for decorative and aesthetic purposes. For example, under/outer garment 10 of FIG. 5 illustrates buttons 24 along the front of the garment. These buttons may be functional or ornamental. Other variations may be implemented.

Figure 7:
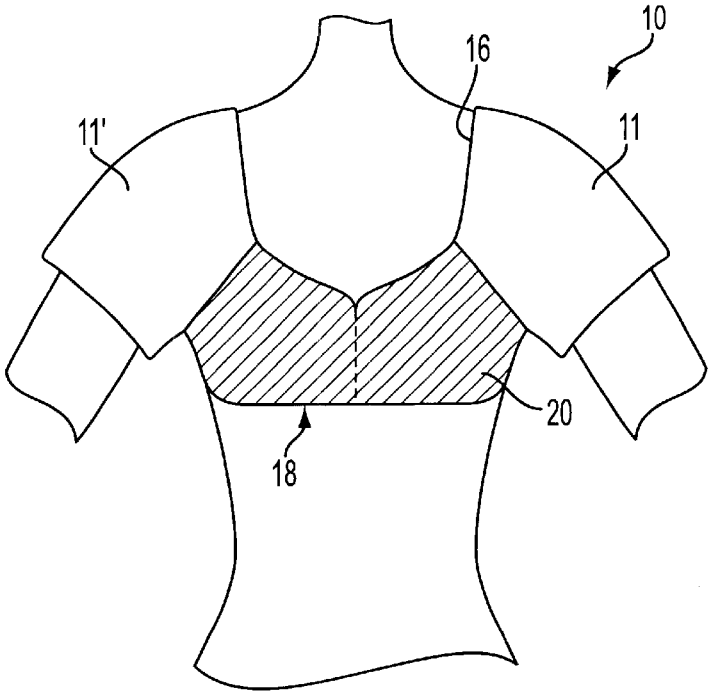
FIGS. 7 and 8 illustrate front and back view of yet another embodiment of the present invention including a multiple material covering.

FIGS. 7 and 8 illustrate front and back views of an embodiment of the present invention wherein different materials may be used to create a desired look. For example, brassiere section 20 and sleeves 11 and 11' (which may include shoulder sections 13 and 13') may be made of differential materials. Other variations may be implemented for creating a desired look. For example, brassiere section 20 may be made of a first supportive material, such as a cotton/elastic blend, and the sleeves 11 and 11' (which may include shoulder sections 13 and 13') may be made of a second material, such as silk, cotton, sheer fabric or other material or blend of materials. According to an embodiment of the present invention, the under/outer garment may be worn snuggly over a conventional brassiere or worn alone.

As discussed above, the women's under/outer garment according to the present invention may provide coverage or concealment of a wearer's arms without the addition of undue bulkiness about the torso of the wearer. The term "undue bulkiness" may be intended to mean bulkiness which may significantly inhibit the free movement of the wearer, or significantly detract from the aesthetic appearance of the wearer, as readily understood by one of skill in the art. This may be accomplished by providing an under/outer garment for fitting snuggly over a conventional brassiere with attached (or permanent) sleeves for covering the arms of the wearer.

By enabling the women's under/outer garment to fit snuggly over a conventional brassiere, manufacturing and other costs may be reduced by not incorporating a brassiere into the garment. As the material of the brassiere section of the present invention may have elastic qualities, the under/outer garment of the present invention may stretch over a conventional brassiere to create a comfortable and more exact fit without incorporating a brassiere of an exact size of the wearer into the garment. Other advantages may be recognized.

According to another embodiment of the present invention, the under/outer garment may be worn without a conventional brassiere wherein a brassiere section of the garment may be made of a supportive material, such as foam, spandex or an elastic blend. Other materials for providing support may be implemented as well. This embodiment enables the wearer to wear the women's sleeved under/outer garment of the present invention alone rather than with a conventional brassiere.

Undue bulkiness may be prevented by virtue of the cropped form of the sleeved under/outer garment of the present invention. For example, the sleeved under/outer garment may not extend below the lower midriff edge of the back strap of the brassiere, thereby eliminating any bulk about the lower portion of the torso of the wearer.

While the present invention has primarily been described with reference to concealing the arm's of the wearer, it should be understood that the garment may be worn in any situation where the wearer desires to expand the versatility of the sleeveless apparel. For instance, wearer's of all ages may use the sleeved under/outer garment of the present invention in situations where sleeveless apparel might otherwise be inappropriate or undesirable, such as cooler weather. A wearer may also wear the under/outer garment of the present invention with strapless apparel to create more coverage about the arms and shoulders, or as otherwise desired. As such, the sleeved under/outer garment of the present invention may be used under any circumstances where the wearer may desire to cover their arms, without undue bulkiness about their torso.

While particular embodiments of the present invention have been described and shown, the invention is not intended to be restricted to any particular construction, arrangement, or specific embodiment disclosed herein, or any specific method or operation or use, since the same may be modified in various particulars, without departing from the spirit or scope of the invention herein shown, the scope of which is set forth in the claims.

What is claimed is:

1. A women's sleeved garment for fitting over a conventional brassiere and for covering an intended wearer's arms without adding undue bulkiness about a torso of the intended wearer comprising:

a brassiere section comprising a supportive material for fitting snuggly over a conventional brassiere of the intended wearer wherein the brassiere section further comprises a back section which encircles a mid-torso region of the intended wearer, and a pair of sleeves extending from the brassiere section for covering the intended wearer's arms and shoulders without adding undue bulkiness about the torso of the intended wearer.

2. The women's sleeved garment of claim 1 wherein the sleeves include an elasticized portion along an under-arm region of the intended wearer to further prevent undue bulkiness about the torso of the intended wearer.

3. The women's sleeved garment of claim 1 wherein the supportive material comprises one or more of elastic and foam.

4. The women's sleeved garment of claim 1 wherein the sleeves are made of a second material which is different from the supportive material of the brassiere section.

5. The women's sleeved garment in claim 1 wherein the brassiere section and pair of sleeves comprise a substantially similar material.

6. The women's sleeved garment in claim 1 wherein the back section extends to a lower midriff edge of a conventional brassiere of the intended wearer.

7. A women's sleeved garment for covering an intended wearer's arms without adding undue bulkiness about a torso of the intended wearer comprising:

a brassiere section comprising a supportive material for forming cups for fitting snuggly over an intended wearer wherein the brassiere section further comprises a back section which encircles a the mid-torso region of the intended wearer and extends to a midriff edge slightly below a bust line of the intended wearer, and a pair of sleeves extending from the brassiere section for covering the intended wearer's arms without adding undue bulkiness about the torso of the intended wearer.

8. The women's sleeved garment of claim 7 wherein the sleeves include an elasticized portion along an under-arm region of the intended wearer to further prevent undue bulkiness about the torso of the intended wearer.

9. The women's sleeved garment of claim 7 wherein the supportive material comprises one or more of elastic and foam.

10. The women's sleeved garment of claim 7 wherein the sleeves are made of a second material which is different from the supportive material of the brassiere section.

11. The women's sleeved garment in claim 7 wherein the brassiere section and pair of sleeves comprise a substantially similar material.

* * * * *